US005601373A

United States Patent [19]

Fox

[11] Patent Number: 5,601,373

[45] Date of Patent: Feb. 11, 1997

[54] SPUR GEAR RATCHET MECHANISM FOR THERMAL TRANSFER PRINTER

[75] Inventor: Duane M. Fox, Snohomish, Wash.

[73] Assignee: Intermec Corporation, Everett, Wash.

[21] Appl. No.: 591,967

[22] Filed: Jan. 29, 1996

[51] Int. Cl.[6] ..... B41J 29/387

[52] U.S. Cl. ..... 400/191; 74/411.5

[58] Field of Search ..... 400/191, 663, 400/668; 74/411.5, 405; 192/135, 148; 312/208.3; 242/550

[56] References Cited

U.S. PATENT DOCUMENTS

| | | | |
|---|---|---|---|
| 3,866,851 | 2/1975 | Brooks | 242/421.9 |
| 3,899,143 | 8/1975 | Slezak | 242/156.2 |
| 3,949,949 | 4/1976 | Thompson | 242/421 |
| 3,985,603 | 10/1976 | Berner | 156/235 |
| 3,985,605 | 10/1976 | Treiber et al. | 156/384 |
| 3,989,929 | 11/1976 | Treiber | 235/432 |
| 4,120,245 | 10/1978 | Karp et al. | 101/288 |
| 4,350,454 | 9/1982 | Schoenlein | 400/234 |
| 4,363,692 | 12/1982 | Imamura et al. | 156/351 |
| 4,370,045 | 1/1983 | Holmes | 354/304 |
| 4,521,125 | 6/1985 | Turbon | 400/208 |
| 4,721,267 | 1/1988 | Nieto et al. | 400/219 |
| 5,051,011 | 9/1991 | Satoh et al. | 400/219 |
| 5,302,037 | 4/1994 | Schoendienst et al. | 400/578 |
| 5,437,511 | 8/1995 | Halket et al. | 400/668 |

FOREIGN PATENT DOCUMENTS 63-194971 8/1988 Japan .

*Primary Examiner*—Edgar S. Burr
*Assistant Examiner*—Daniel J. Colilla
*Attorney, Agent, or Firm*—Graham & James LLP

[57] ABSTRACT

A spur gear ratchet mechanism is provided to enable simplified replacement of a ribbon roll for a thermal transfer printer. The spur gear ratchet mechanism is intended for use with a printer comprising a fixed base portion and a pivotal cage portion in which the cage portion can be selectively moved between a closed operational position and an open non-operational position. A transporting mechanism controls the movement of the thermal transfer ribbon, and is attached to the pivotal cage portion so that it moves in association therewith. The transporting mechanism comprises at least one rotatable hub that is driven by an associated drive gear. When the cage portion moves from the closed operational position to the open non-operational position, the drive gear disengages from the pinion of a drive motor that is fixed within the base portion of the printer. Concurrently, the spur gear ratchet mechanism engages the drive gear and impedes undesirable rotation of the hub. With the hub held in a substantially non-rotating state by the spur gear ratchet mechanism, an operator can readily orient the ribbon roll so that it seats properly onto the supply hub.

20 Claims, 6 Drawing Sheets

SPUR GEAR RATCHET MECHANISM FOR THERMAL TRANSFER PRINTER

BACKGROUND OF THE INVENTION

1. Field of the Invention

The present invention relates to thermal transfer printing, and more particularly, to an apparatus for temporarily locking the ribbon hubs of a thermal transfer printer to permit replacement of a rotating ribbon roll.

2. Description of Related Art

In the field of bar code symbology, vertical bars of varying thicknesses and spacing are used to convey information, such as an identification of the object to which the bar code is affixed. The bar codes are typically printed onto paper substrate labels having an adhesive backing layer that enables the labels to be affixed to objects to be identified. To read the bar code, the bars and spaces are scanned by a light source, such as a laser. Since the bars and spaces have differing light reflective characteristics, the information contained in the bar code can be read by interpreting the laser light that reflects from the bar code. In order to accurately read the bar code, it is thus essential that the bar code be printed in a high quality manner, without any streaking or blurring of the bar code. At the same time, it is essential that the adhesive backing layer of the labels not be damaged by heat generated during the printing process.

In view of these demanding printing requirements, bar codes are often printed using thermal transfer printing techniques. In thermal transfer printing, a label sheet of the print media is drawn between a platen and a thermal print head. A thermally active ink ribbon is drawn along in parallel with the label sheet between the platen and the thermal print head. The thermal print head has linearly disposed printing elements that extend across a width dimension of the label sheet. The printing elements are individually activated in accordance with instructions from a controller. As each printing element is activated, the thermally active chemical of the ribbon activates at the location of the particular printing element to transfer ink to the printed area of the label sheet. The label sheet is continuously drawn through the region between the platen and the thermal print head, and in so doing, the bar code is printed onto the label as it passes through the region. Other images, such as text characters, can be printed in the same manner.

The thermal transfer printer includes a mechanism for transporting the ribbon from a supply hub to the print region. It is desirable within the art to increase the rate at which the labels are printed. At the same time, it is also desirable to increase the overall width of the label (e.g., up to seven inches). Since the ribbon must be at least as wide as the print media, the increasing media size has driven a corresponding increase in size and weight of the ribbon roll (e.g., up to ten pounds). As a result, it is increasingly difficult to install a replacement ribbon roll onto its associated supply hub.

Typically, the ribbon supply hub is disposed within a ribbon transporting assembly of a cage portion of the printer. The cage portion can be pivoted upward to expose the ribbon supply hub as well as the media supply, enabling an operator to service the printer and replace the ribbon and/or media as required. The relatively heavy motors that drive the supply and take-up hubs disengage from the hubs when the cage is pivoted upward. The supply and take-up hubs have a key that mates with an associated notch of the ribbon roll core when the roll is oriented properly. The operator rotates the ribbon roll until the key engages the notch, which permits the roll to seat properly on the supply hub.

A vexing problem often experienced by operators of thermal transfer printers is the difficulty in getting the notch to mate properly with the supply hub key while attempting to replace the ribbon roll. With the motors disengaged from the supply and take-up hubs, the hubs rotate freely in the absence of rotational friction ordinarily provided by the motors. As the ribbon roll is rotated manually by the operator in an attempt to mate the notch and key, the hub is caused to rotate cooperatively with the ribbon roll, and thus, the notch never engages the hub key. The weight of the ribbon roll resting on the hub contributes to the difficulty in manipulating the roll into a proper position. To overcome this problem, the operator will typically remove and reinstall the ribbon roll onto the hub repeatedly until the notch and hub key eventually come into alignment.

Accordingly, it would be desirable to provide a mechanism for a thermal transfer printer that would hold the ribbon hub in a non-rotating state to facilitate replacement of the ribbon roll. Such a holding mechanism should permit rapid replacement of the ribbon roll without impeding movement of the ribbon hub during normal operation of the printer. At the same time, the mechanism should not overly complicate the printer or substantially increase its production cost.

SUMMARY OF THE INVENTION

In accordance with the teachings of this invention, a spur gear ratchet mechanism is provided to enable simplified replacement of a ribbon roll for a thermal transfer printer. The spur gear ratchet mechanism is intended for use with a printer comprising a fixed base portion and a pivotal cage portion. The cage portion can be selectively moved between a closed operational position and an open non-operational position. A print region is defined within the fixed base portion, and the print media is drawn to the print region for printing of symbology or other information thereon.

A transporting mechanism controls the movement of the thermal transfer ribbon to the print region, and is attached to the pivotal cage portion so that it moves in association therewith. The transporting mechanism comprises at least one rotatable hub that is driven by an associated drive gear. The hub is capable of carrying a roll of the thermal transfer ribbon, and has an orientation key which corresponds to an associated notch of the ribbon roll. A drive motor is fixedly attached to the base portion and has a pinion that engages with the drive gear only upon movement of the cage portion to the closed operational position. When the cage portion moves from the closed operational position to the open non-operational position, the drive gear disengages from the pinion of the drive motor. At the same time, the spur gear ratchet mechanism engages the drive gear and impedes undesirable rotation of the hub. With the hub held in a substantially non-rotating state by the spur gear ratchet mechanism, an operator can readily orient the ribbon roll onto the supply hub.

More particularly, the spur gear ratchet mechanism comprises a flexible arm member that is coupled at a first end to the pivotal cage portion and has a spur gear disposed at a second end thereof. The spur gear is normally biased into a position engaging a portion of the drive gear. With the spur gear engaging the drive gear, an operator can selectively rotate the hub in a step-wise fashion due to the ratchet action of the spur gear, but the hub is effectively precluded from free rotation. To disengage the spur gear mechanism, a post is provided which extends from the base portion into a region proximate the flexible arm member. The post contacts the arm member only upon the cage portion being in the closed operational position, whereby the post deflects the flexible arm member to bring the spur gear out of engagement with the drive gear to permit unimpeded rotation of the drive gear by the drive motor.

A more complete understanding of the spur gear ratchet mechanism for a thermal transfer printer will be afforded to those skilled in the art, as well as a realization of additional advantages and objects thereof, by a consideration of the following detailed description of the preferred embodiment. Reference will be made to the appended sheets of drawings which will first be described briefly.

DETAILED DESCRIPTION OF THE PREFERRED EMBODIMENT

Figure 2:
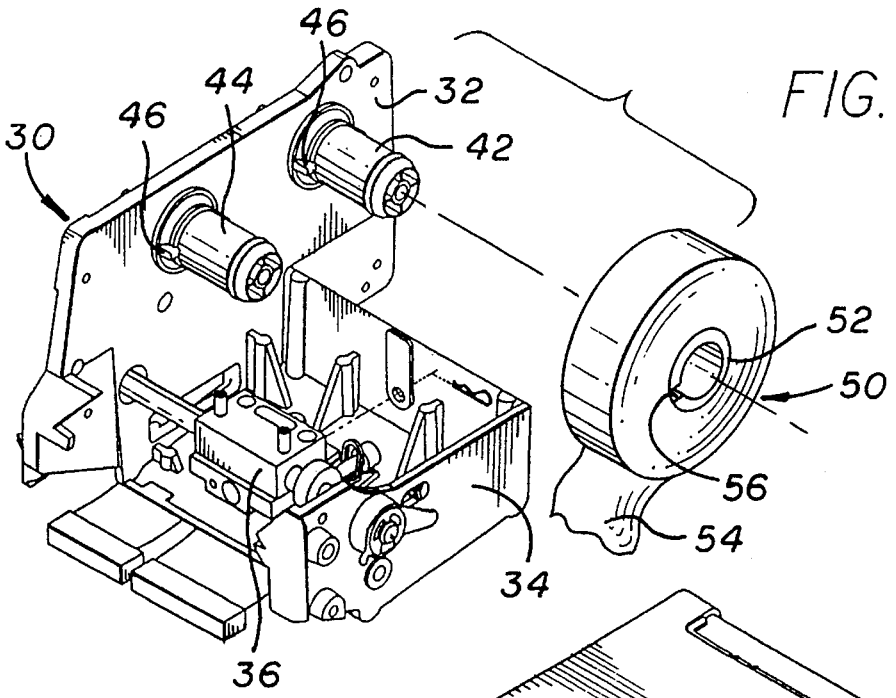
FIG. 2 is a perspective view of a ribbon transporting mechanism of the thermal transfer printer.

The present invention satisfies the need for a mechanism for a thermal transfer printer that holds the ribbon hub in a non-rotating state to facilitate replacement of the ribbon roll. The present mechanism permits rapid replacement of the ribbon roll without impeding movement of the ribbon hub during normal operation of the printer, and does not substantially complicate the printer or increase its production cost. In the detailed description that follows, like reference numerals are used to describe like elements of one or more of the figures.

Figure 1:
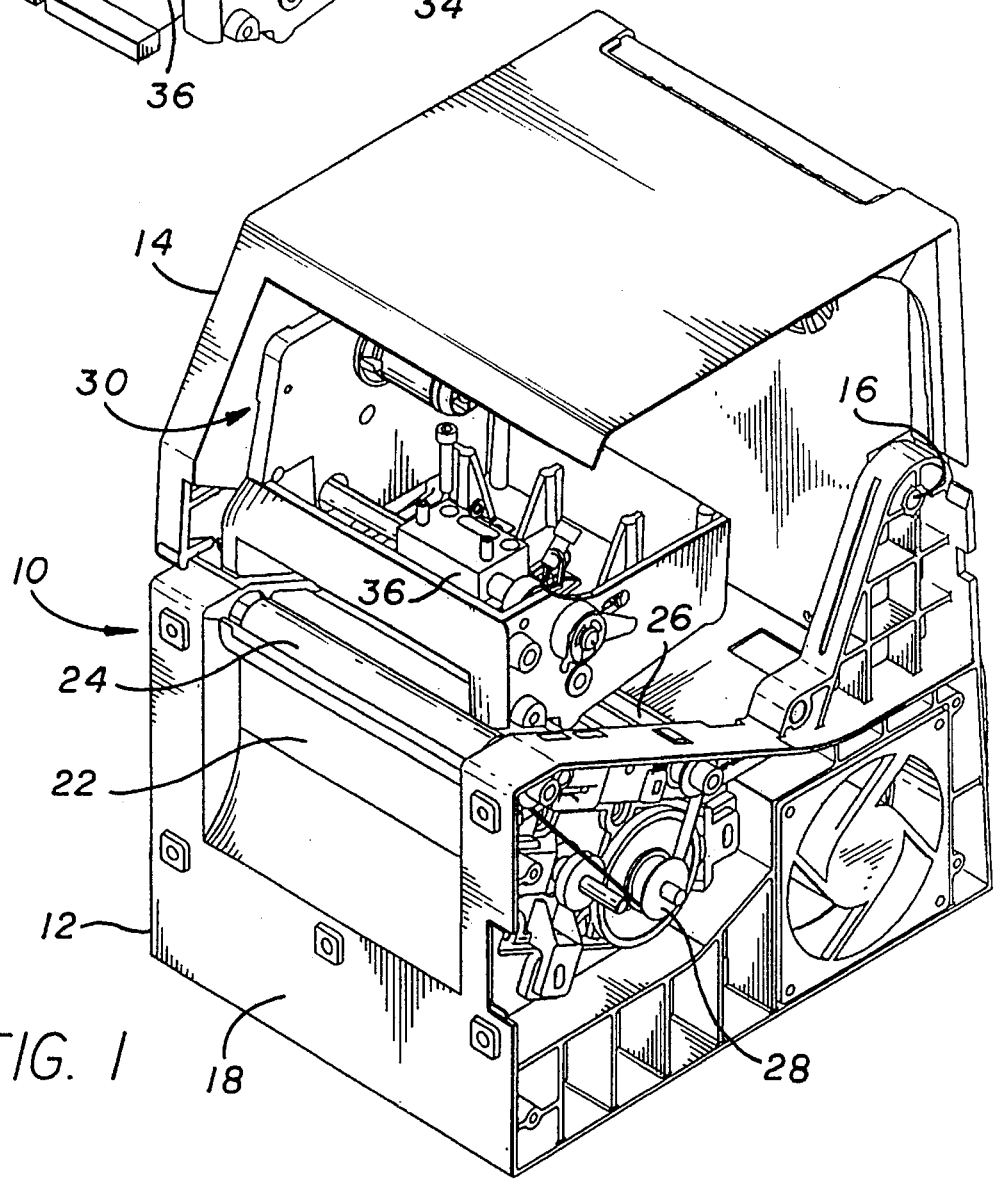
FIG. 1 is a front perspective view of a thermal transfer printer of the present invention.

Referring first to FIG. 1, a thermal transfer printer 10 is illustrated with a side panel omitted to show certain internal features of the printer. The printer 10 comprises a base portion 12 that remains substantially stationary, and a cage portion 14 that is movable to provide an operator with access into the printer. The cage portion 14 is pivotally attached to the base portion at a pivot point 16 that permits the cage portion to be pivoted upward and away from the base portion. As will be clear from the detailed description that follows, the printer 10 is in an operational state with the cage portion 14 pivoted fully downward to contact the base portion 12, and is in a non-operational or maintenance state with the cage portion pivoted upward.

The base portion 12 comprises a housing having a front surface 18 having an indented print media feed region 22. The base portion 12 further comprises a print media transporting mechanism that includes a series of rollers 24, 26 that are driven by a transmission system 28. As known in the art, the transmission system 28 may further include a drive motor and associated gears and/or belts that cause the rollers 24, 26 to evenly transport the print media from a spool or storage supply (not shown) past a print region. The print media comes into contact with the thermal transfer ribbon (described below) at the print region. Following a printing operation of the printer 10, the print media is discharged through the feed region 22 by operation of the rollers 24, 26.

The cage portion 14 comprises a movable cover that hinges from a rear surface of the base portion 12. The cage portion 14 includes a ribbon transporting mechanism 30 that is coupled to the cage portion such that it moves in association with the cage portion. The ribbon transporting mechanism 30 controls movement of the thermal transfer ribbon through the print region in parallel with the moving print media. With the cage portion 14 pivoted to the closed operational position, the ribbon transporting mechanism 30 comes into contact with the path traveled by the print media between the rollers 24, 26. A thermal print head 36 faces downward toward an underside of the ribbon transporting mechanism 30 so that the thermal transfer ribbon passes between the thermal print head and the print media. As known in the art, selective thermal activation of individual thermal elements of the thermal print head causes a chemical reaction in the thermal transfer ribbon, which further causes ink to transfer onto the moving print media. The thermal transfer ribbon may be transported at the same rate as the print media, or may be transported at a slower rate in order to conserve the ribbon.

As shown in greater detail in FIG. 2, the ribbon transporting mechanism 30 comprises a back wall 32 having a generally rectangular shape. The back wall 32 provides primary structural strength for the ribbon transporting mechanism, and may comprise a rigid, high strength, and light weight material, such as aluminum. A bucket 34 extends perpendicularly from the back wall 32, and provides a guide path for the moving thermal transfer ribbon and a housing for the thermal print head 36. The thermal print head 36 is electrically connected to a central control processor (not shown) of the printer 10 to provide data in the form of electrical signals that direct the selective activation of individual thermal elements within the print head.

The ribbon transporting mechanism 30 further comprises a pair of hubs 42, 44, referred to herein as the supply and take-up hubs, respectively. Each of the hubs 42, 44 are cylindrical in shape and extend perpendicularly from the back wall 32. The hubs 42, 44 are rotatable about a central axis thereof. In addition, the hubs 42, 44 have an orientation key 46 that extends radially from an outer circumferential surface of the hubs at the proximal end of the hubs adjacent to the intersection with the back wall 32. The keys 46 facilitate proper seating between the hubs 42, 44 and respective rolls of thermal transfer ribbon, such as the exemplary ribbon roll 50 of FIG. 2.

More particularly, the exemplary ribbon roll 50 comprises a core 52 onto which a quantity of thermal transfer ribbon 54 is wound. The core 52 has a radially disposed notch 56 that is adapted to receive a respective one of the orientation keys 46 when the roll 50 has the proper rotational orientation with respect to the hub. The core 52 is tube-shaped having a hollow center, and may comprise a light weight, disposable material, such as cardboard or plastic. With a ribbon roll 50 seated properly onto the hub 42, the ribbon 54 can be drawn around the bucket 34 so that it passes the downward facing thermal print head 36. Thereafter, the expended ribbon is collected on a similarly situated roll core 52 that is mounted onto the take-up hub 44.

The pivotal cage portion 14 enables an operator to periodically load a replacement roll of thermal transfer ribbon onto the supply hub 42, and remove the expended roll from the take-up hub 44. To accomplish this, the cage portion 14 is pivoted upward to give the operator access to the ribbon transporting mechanism 30. The expended roll is removed in an axial direction relative to the central axis of the hub 44 to dislodge the roll from the hub. Reinstalling the replacement roll onto the hub is more problematic, since it requires the operator to align the orientation key 46 with the notch 56. As further described below, this replacement task is simplified greatly by use of the spur gear ratchet mechanism that holds the hub in a non-rotating state when the cage portion 14 is pivoted upward.

Figure 3:
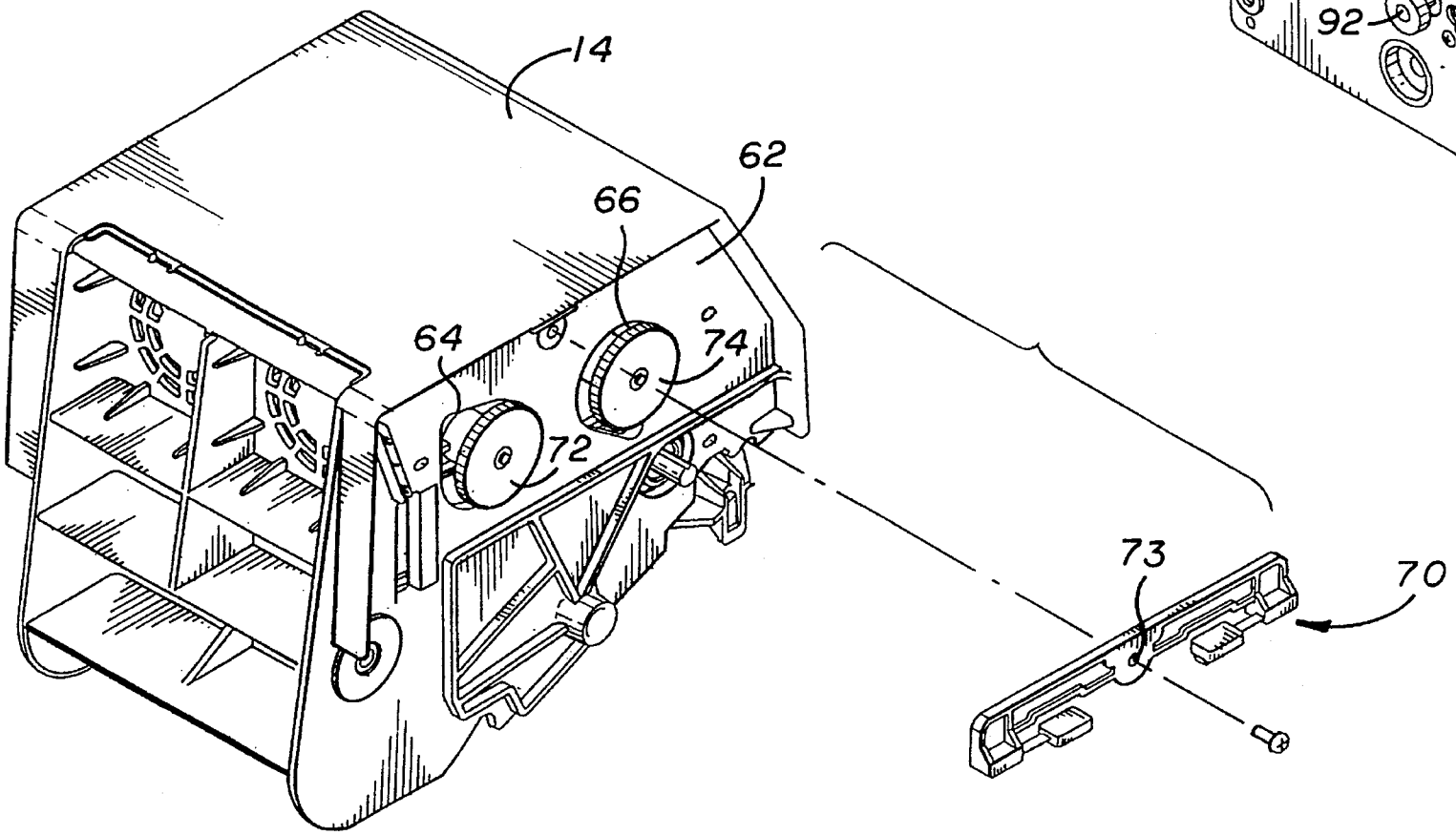
FIG. 3 is a side perspective view of a cage portion of the thermal transfer printer.

FIG. 3 illustrates the cage portion 14 from another perspective, and shows the other side of the ribbon transporting mechanism. The cage portion 14 has a side panel 62 to which the back wall 32 of the ribbon transporting mechanism 30 is mounted. The side panel 62 has a pair of openings 64, 66 that permits respective drive gears 72, 74 to extend therethrough. The drive gears 72, 74 are axially coupled to the hubs 42, 44, respectively, at an opposite side of the back wall 32. The hubs 42, 44 are driven by applying a rotational force to the respective drive gears 72, 74 by drive motors, as described below. The spur gear ratchet mechanism 70 is also attached to the side panel 62. As shown in FIG. 3, the spur gear ratchet mechanism 70 is secured to the side panel 62 by a conventional screw or bolt through a mounting hole 73. It should be apparent that alternative mounting methods for the spur gear ratchet mechanism 70 are also possible, or the spur gear mechanism could be integrally formed with the side panel 62 of the cage portion 14. The spur gear ratchet mechanism 70 will be described in greater detail below.

Figure 8:
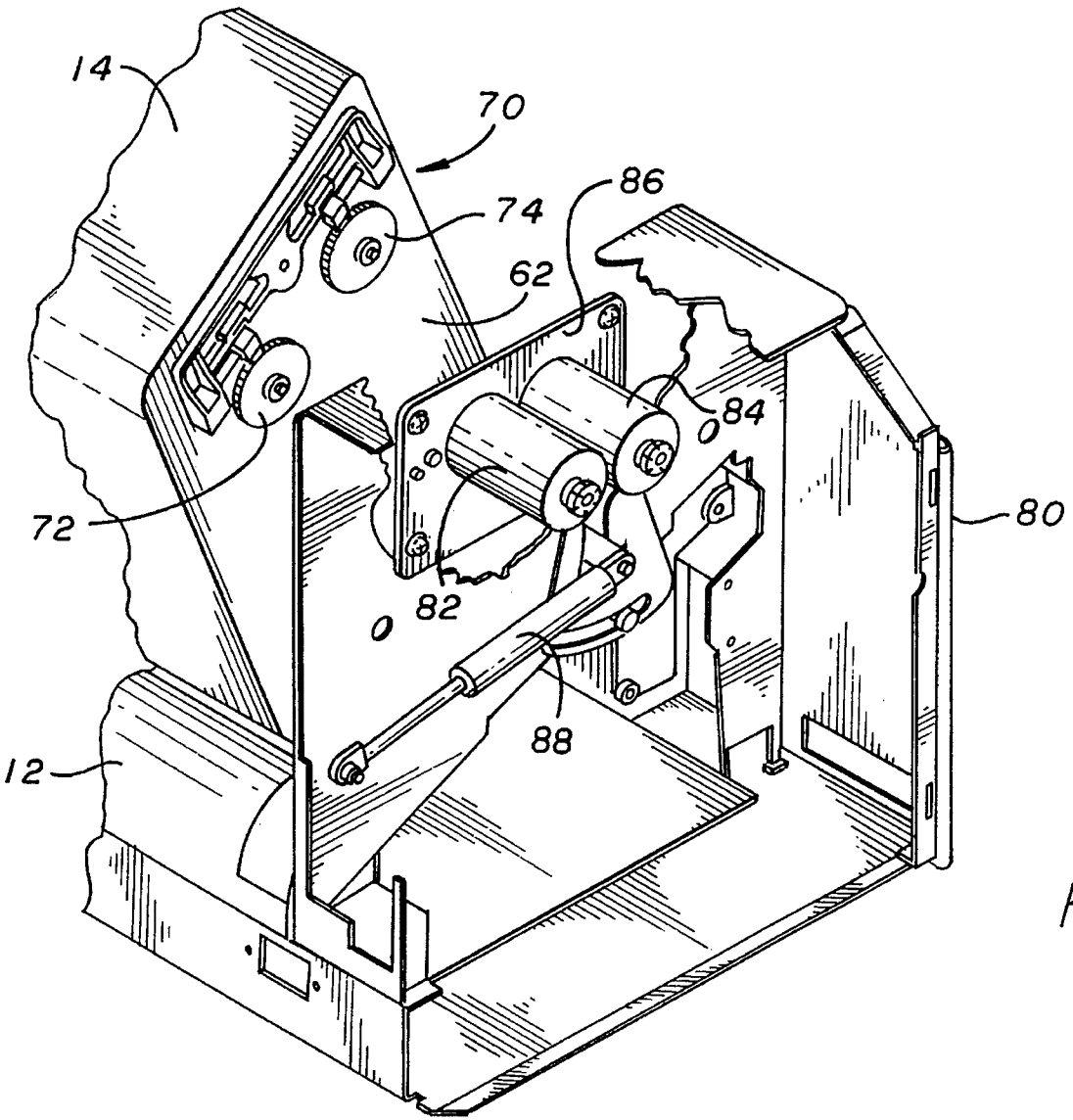
FIG. 8 is a partial side perspective view of the cage portion pivoted to a non-operational position relative to a fixed base portion of the thermal transfer printer.

Mechanical operation of the hubs 42, 44 will now be described with reference to FIGS. 4 and 8, in which drive motors 82, 84 are illustrated. The drive motors 82, 84 are mounted onto a drive plate 86 that structurally supports the motors. As best shown in FIG. 8, the drive plate 86 is coupled to a tower portion 80 which is integral with the base portion 12 described above. Like the base portion 12, the tower portion 80 does not pivot with the cage portion 14, but instead provides a storage cabinet for the drive motors 83, 84, as well as other fixed components of the printer 10, such as electronic circuit boards, power supplies, etc. The tower portion 80 may further include a piston 88 that enables smooth pivoting of the cage portion 14 relative to the base portion 12. It should be apparent that by offloading certain high weight components to the tower portion 80, the weight of the cage portion 14 can be reduced, thus making it easier to pivot open and closed.

Figure 4:
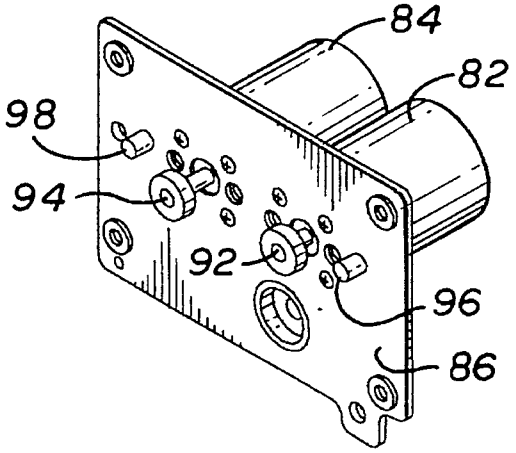
FIG. 4 is a perspective view of drive motors used to drive the ribbon transporting mechanism.

The drive motors 82, 84 further have axially coupled pinion gears 92, 94, respectively, disposed at an opposite side of the drive plate 86, as shown in FIG. 4. The pinion gears 92, 94 mesh with the drive gears 72, 74, respectively, when the cage portion 14 is pivoted downward to the operation position. Conversely, when the cage portion 14 pivots upward, as shown in FIG. 8, the pinion gears 92, 94 disengage from the drive gears 72, 74. The drive motors 82, 84 may comprise DC or stepper motors that can move the thermal transfer ribbon at a desired rate corresponding to motion of the print media. The drive plate 86 further includes a pair of posts 96, 98 that extend perpendicularly from the drive plate parallel to the pinion gears 92, 94. The posts 96, 98 are positioned to interact with the spur gear ratchet mechanism 70 described below.

Figure 5:
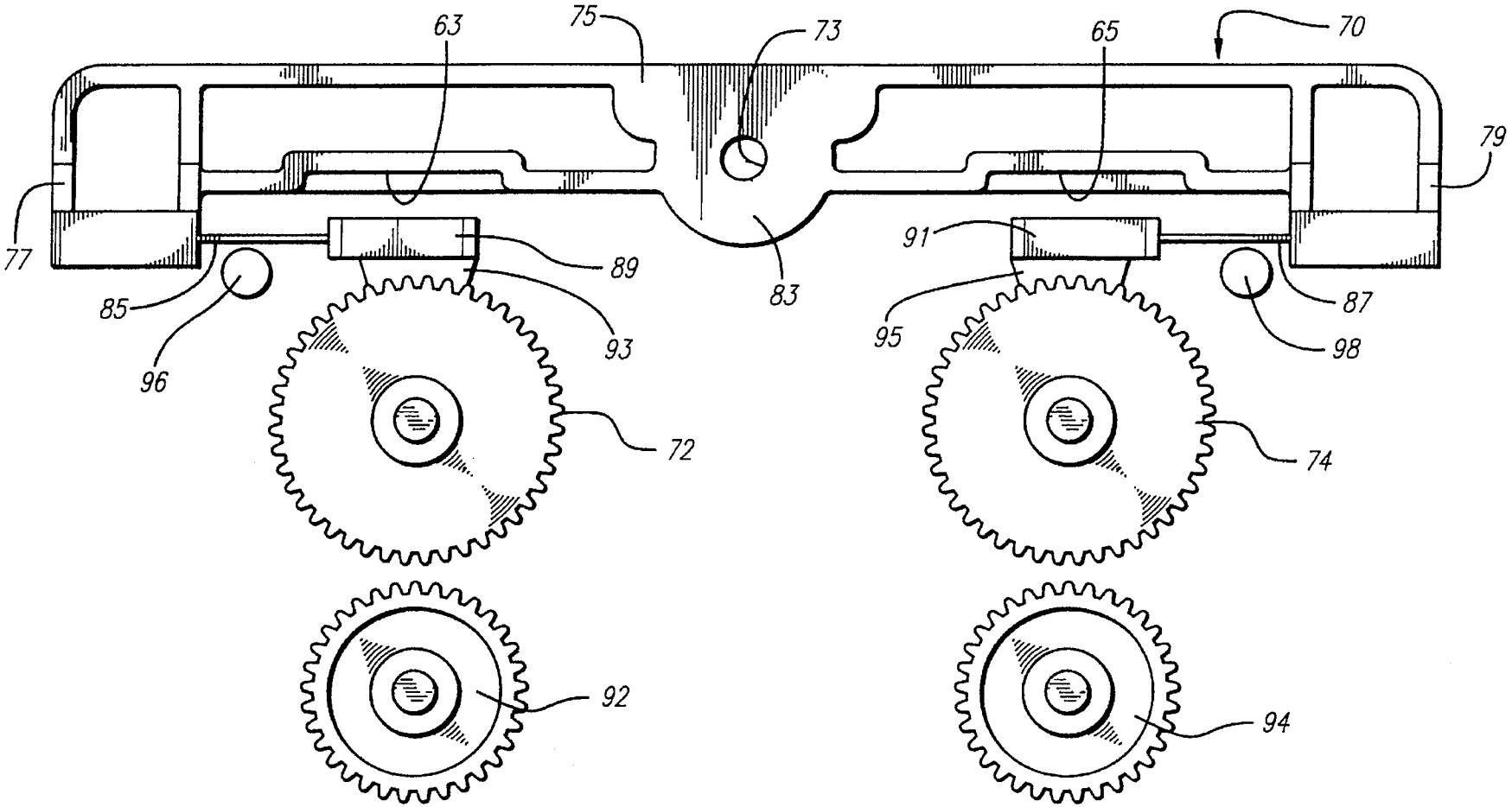
FIG. 5 is an enlarged front view of the spur gear ratchet mechanism engaging the drive gears to impede rotation of the drive gears.
Figure 6:
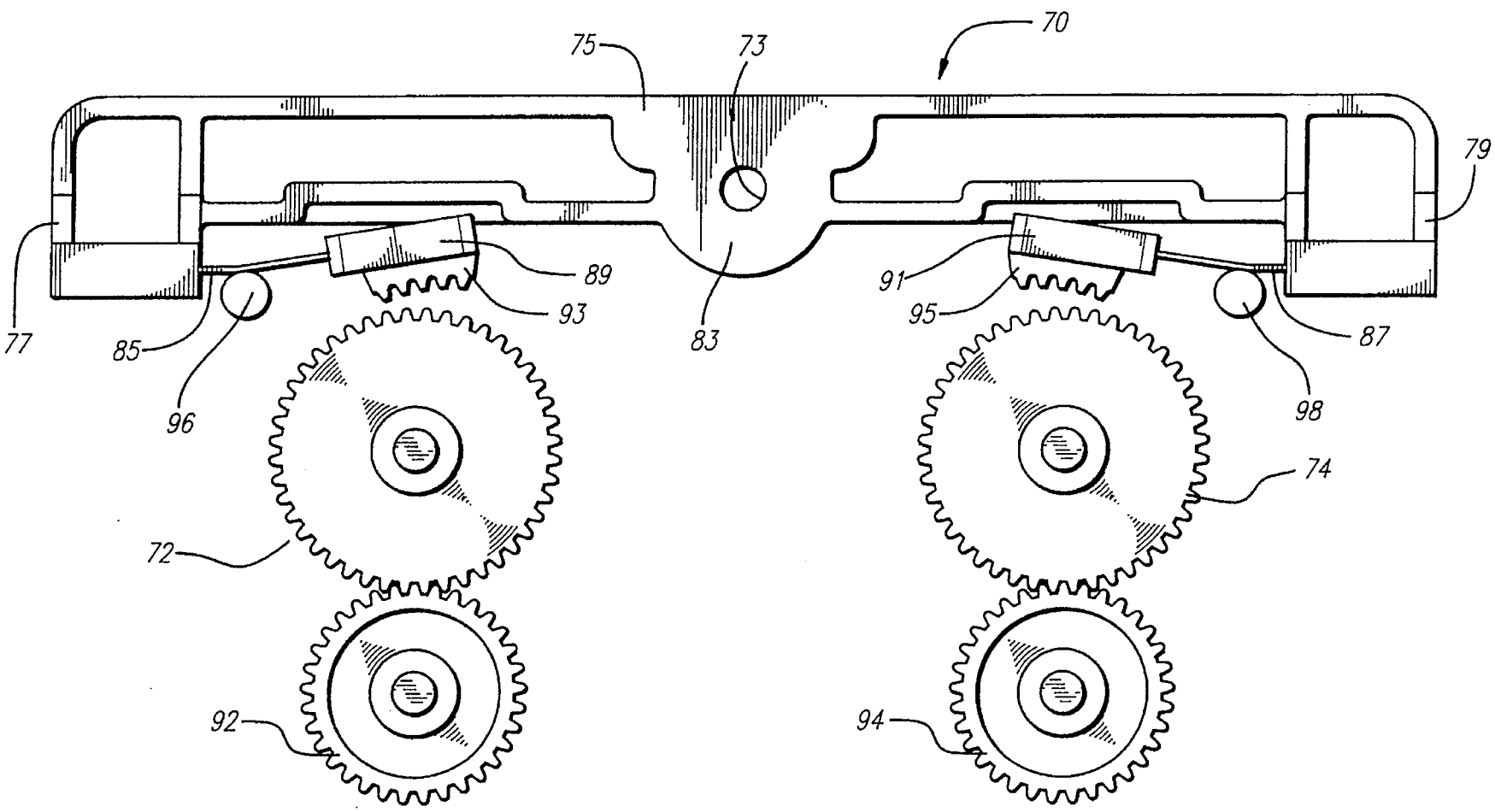
FIG. 6 is an enlarged front view of the spur gear ratchet mechanism disengaged from the drive gears to permit rotation of the drive gears by the respective drive motors.

The spur gear ratchet mechanism 70 is best illustrated in FIGS. 5 and 6. The spur gear ratchet mechanism 70 includes an elongated body portion 75 comprising parallel frame members with a central joining web 83. The mounting hole 73 described above is substantially centered in the web 83. The body portion 75 further has opposing ends 77, 79 that provide a stable base for operation of the spur gear ratchet mechanism 70. Flexible arm members 85, 87 extend inward toward a center of the body portion 75 substantially parallel with the frame members. The arm members 85, 87 are fixed at proximal ends thereof to the ends 77, 79, respectively. The arm members 85, 87 have a natural spring bias that causes them to normally extend parallel to the frame members. At the distal ends of the arm members 85, 87, respective spurs 89, 91 are disposed. The spurs 89, 91 further have respective spur gears 93, 95 extending from a lower side surface of the spurs. The spur gears 93, 95 respectively have gear teeth that coincide with the teeth of the drive gears 72, 74.

Operation of the spur gear ratchet mechanism 70 will now be described. FIG. 6 illustrates the spur gear ratchet mechanism 70 with the cage portion pivoted downward to the operational position. In this position, the posts 96, 98 contact the arm members 85, 87, respectively, and deflect the arm members such that the spur gears 93, 95 are disengaged from the drive gears 72, 74. At the same time, the pinions 92, 94 engage the respective drive gears 72, 74, enabling the drive gears to be driven by the drive motors 82, 84, in the manner described above. As shown in FIG. 6, the body portion 75 of the spur gear ratchet mechanism 70 may further include recessed regions 63, 65 that accommodate the movement of the spurs 89, 91 as they deflect upward.

Figure 7:
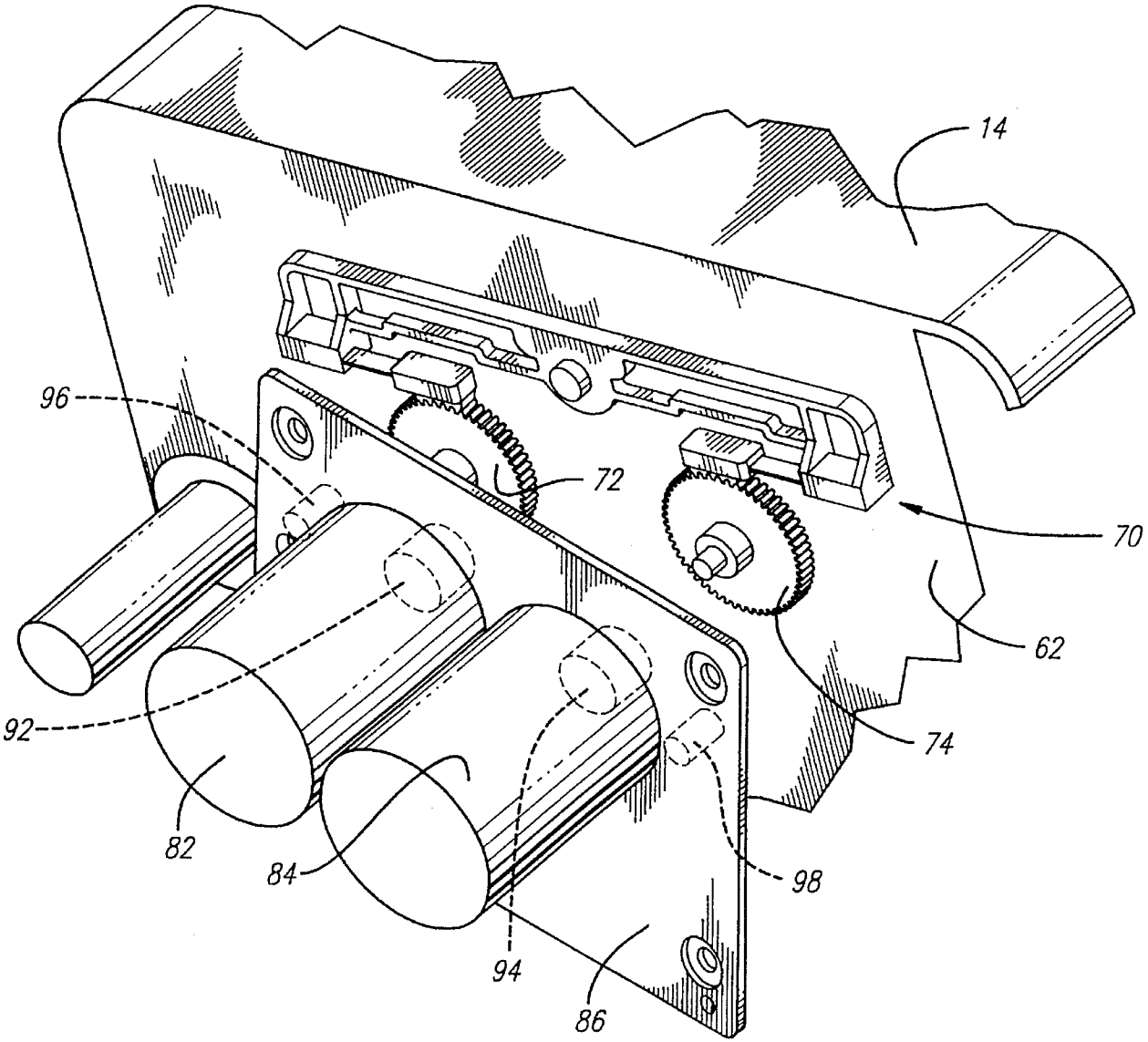
FIG. 7 is an enlarged view of the cage portion illustrating a spur gear ratchet mechanism engaging drive gears of the ribbon transporting mechanism.

Conversely, FIG. 5 illustrates the spur gear ratchet mechanism 70 with the cage portion pivoted upward to the non-operational position. In this position, the posts 96, 98 are out of contact with the arm members 85, 87, respectively, and as a result, the arm members extend parallel to the body portion 75 due to their natural bias. Accordingly, the spur gears 93, 95 engage the drive gears 72, 74 and preclude rotation of the drive gears. The pinions 92, 94 no longer engage the respective drive gears 72, 74, and cannot be driven by the drive motors 82, 84. FIG. 7 also illustrates the spur gear ratchet mechanism 70 with the cage portion 14 being pivoted to the non-operational position.

It should be apparent that the spur gears 93, 95 do permit selective rotation of the drive gears 72, 74 by the operator due to their ratchet-like operation. For example, drive gear 72 can be rotated clockwise (as shown in FIG. 5) by a counter-clockwise manual rotation of the hub 42 in an incremental manner; however, the hub cannot be manually rotated in the opposite direction. In this way, the operator can selectively rotate the hub 42 to move the orientation key 46 to a desired spot to facilitate installation of a ribbon roll 50. Once the hub 42 is rotated to the desired spot, the hub will remain substantially fixed regardless of movement of the ribbon roll 50 by the operator.

Having thus described a preferred embodiment of a spur gear ratchet mechanism for a thermal transfer printer, it should be apparent to those skilled in the art that certain advantages of the within system have been achieved. It should also be appreciated that various modifications, adaptations, and alternative embodiments thereof may be made within the scope and spirit of the present invention. The invention is further defined by the following claims.

What is claimed is:

1. An apparatus for printing symbology onto a print media, comprising:

a housing having a fixed base portion and a pivotal cage portion, said cage portion being selectively moveable between a closed operational position and an open non-operational position;

a print region disposed within said housing and means for drawing said print media to said print region;

means for transporting a thermal transfer ribbon to said print region, said transport means comprising at least one rotatable hub driven by an associated drive gear, said hub being capable of carrying a roll of said thermal transfer ribbon, said transporting means being disposed within said pivotal cage portion for selective movement in association therewith;

at least one drive motor fixedly attached to said base portion and having a pinion that engages with said drive gear only upon said cage portion being moved to said closed operational position; and means for impeding rotation of said at least one rotatable hub upon disengagement between said drive gear and said pinion of said at least one drive motor by movement of said cage portion from said closed operational position to said open non-operational position.

2. The apparatus of claim 1, wherein said impeding means further comprises:

a flexible arm member coupled at a first end to said pivotal cage portion and having a spur gear at a second end thereof, said spur gear being normally biased into a position engaging a portion of said drive gear; and a post extending from said base portion into a region proximate said flexible arm member, said post contacting said arm member only upon said cage portion being in said closed operational position, whereby said post deflects said flexible arm member to bring said spur gear out of engagement with said drive gear to permit rotation of said drive gear by operation of said at least one drive motor.

3. The apparatus of claim 1, wherein said at least one hub further comprises a supply hub and a take-up hub.

4. The apparatus of claim 3, wherein said impeding means further comprises a respective arm member associated with each one of said supply hub and said take-up hub, each of said arm members being coupled at a first end to said pivotal cage portion and having a spur gear at a second end thereof, said spur gear engaging a portion of said drive gear upon said cage portion being in said open non-operational position.

5. The apparatus of claim 4, wherein said impeding means further comprises respective posts extending from said base portion into a region proximate each one of said arm members, each said post contacting a respective one of said arm members upon said cage portion being in said closed operational position to deflect said arm members and bring said spur gears out of engagement with said drive gears.

6. The apparatus of claim 1, wherein said at least one hub further comprises an orientation key.

7. The apparatus of claim 1, wherein said impeding means further comprises an arm member coupled to said pivotal cage portion and having a spur gear at an opposite end thereof, said spur gear being normally biased into a position engaging a portion of said drive gear.

8. The apparatus of claim 7, wherein said impeding means further comprises means for deflecting said arm member only upon said cage portion being in said closed operational position to bring said spur gear out of engagement with said drive gear.

9. In a thermal transfer printer having a housing capable of selective movement between a closed operational position and an open maintenance position, and means for drawing a print media to a print region of said printer, an improvement comprising:

means for transporting a thermal transfer ribbon to said print region, said transporting means comprising a supply hub and a take-up hub each having an associated drive gear and a drive motor, said supply hub and said take-up hub being driven by respective ones of said drive gears, said drive gears being in mesh with respective ones of said drive motors only upon said housing being pivoted to said closed operational position; and means for engaging said respective drive gears to impede rotation of said supply hub and said take-up hub only upon said housing being pivoted to said open maintenance position.

10. The thermal transfer printer of claim 9, wherein said supply hub and said take-up hub each further comprises an orientation key corresponding to an orientation notch of a thermal transfer ribbon roll.

11. The thermal transfer printer of claim 9, wherein said engaging means further comprises ratchet arms associated with said respective supply and take-up hubs, each said ratchet arm having a fixed first end, a spur gear disposed at a second end thereof, and a flexible portion disposed between said first end and said second end, each said spur gear being capable of engagement with respective ones of said drive gears.

12. The thermal transfer printer of claim 9, wherein said engaging means further comprises at least one arm member coupled to said housing and having a spur gear at an opposite end thereof, said spur gear being normally biased into a position engaging a portion of one of said drive gears.

13. The thermal transfer printer of claim 12, wherein said engaging means further comprises means for deflecting said arm member only upon said housing being in said closed operational position to bring said spur gear out of engagement with said drive gear.

14. The thermal transfer printer of claim 9, wherein said engaging means further comprises:

at least one flexible arm member coupled at a first end to said housing and having a spur gear at a second end thereof, said spur gear being normally biased into a position engaging a portion of one of said drive gears; and a post extending into a region proximate said at least one flexible arm member, said post contacting said arm member only upon said housing being in said closed operational position, whereby said post deflects said flexible arm member to bring said spur gear out of engagement with said drive gear to permit rotation of said drive gear by operation of said drive motor.

15. In a thermal transfer printer having means for drawing a print media to a print region of said printer, an improvement comprising:

means for transporting a thermal transfer ribbon to said print region, said transporting means being capable of selective movement between an operational position and a maintenance position, said transporting means comprising a supply hub and a take-up hub each having an associated drive gear and a drive motor, said supply hub and said take-up hub being driven by respective ones of said drive gears, said drive gears being in mesh with respective ones of said drive motors only upon said transporting means being in said operational position; and means for engaging said respective drive gears to impede rotation of said supply hub and said take-up hub only upon said transporting means being in said maintenance position.

16. The thermal transfer printer of claim 15, wherein said supply hub and said take-up hub each further comprises an orientation key corresponding to an orientation notch of a thermal transfer ribbon roll.

17. The thermal transfer printer of claim 15, wherein said engaging means further comprises ratchet arms associated with said respective supply and take-up hubs, each said ratchet arm having a fixed first end, a spur gear disposed at a second end thereof, and a flexible portion disposed between said first end and said second end, each said spur gear being capable of engagement with respective ones of said drive gears.

18. The thermal transfer printer of claim 15, wherein said engaging means further comprises at least one arm member coupled to said housing and having a spur gear at an opposite end thereof, said spur gear being normally biased into a position engaging a portion of one of said drive gears.

19. The thermal transfer printer of claim 18, wherein said engaging means further comprises means for deflecting said arm member only upon said transporting means being in said operational position to bring said spur gear out of engagement with said drive gear.

20. In a thermal transfer printer having a housing capable of selective movement between a closed operational position and an open maintenance position, means for drawing a print media to a print region of said printer, and means for transporting a thermal transfer ribbon to said print region, said transport means comprising a supply hub and a take-up hub driven by respective drive gears, said drive gears being in mesh with respective drive motors only upon said housing being pivoted to said closed operational position, a method for operating said transport means comprising the steps of:

engaging each of said respective drive gears with associated spur gears to impede rotation of said supply hub and said take-up hub only upon said housing being pivoted to said open maintenance position; and deflecting said associated spur gears out of engagement with said respective drive gears only upon said housing being in said closed operational position.

* * * * *